US005934315A

United States Patent [19]

Braswell et al.

[11] Patent Number: 5,934,315

[45] Date of Patent: Aug. 10, 1999

[54] WASTE WATER ACCESS CHAMBER ASSEMBLAGE

[76] Inventors: C. Richard Braswell, 13829 Creekside Pl., Dallas, Tex. 75240; Don T. Yonts, 3936 Artist Dr., Plano, Tex. 75023

[21] Appl. No.: 08/966,177

[22] Filed: Nov. 7, 1997

[51] Int. Cl.[6] ..... F16L 5/00

[52] U.S. Cl. ..... 137/363; 137/364; 137/373

[58] Field of Search ..... 137/364, 373, 137/363, 372

[56] References Cited

U.S. PATENT DOCUMENTS

| | | | |
|---|---|---|---|
| Re. 28,640 | 12/1975 | Sauriol | 52/19 |
| 1,755,608 | 4/1930 | Lemmerman | 137/373 |
| 3,385,012 | 5/1968 | Lovegreen | 137/363 |
| 3,715,958 | 2/1973 | Crawford et al. | 52/21 |
| 3,813,107 | 5/1974 | Ditcher | 137/363 |
| 4,020,868 | 5/1977 | Schmunk | 137/610 |
| 4,275,757 | 6/1981 | Singer | 137/363 |
| 4,566,483 | 1/1986 | Ditcher | 137/372 |
| 5,361,799 | 11/1994 | Chilton et al. | 137/363 |

*Primary Examiner*—A. Michael Chambers
*Assistant Examiner*—Paul Coryea

[57] ABSTRACT

A molded, polyethylene wastewater chamber assemblage to be assembled and placed below ground level to receive, collect, and transfer wastewater to a treatment plant. The chamber has pipe spigots extending horizontally from its opposing bottom ends that receive input or output pipes of commercially available pipe design, and a riser base on top of the chamber with riser spigot attached thereto that receives a riser of conventional design, and a molded polyethylene lid to seal the riser to be watertight. Two chamber spigot extensions for attachment to the chamber extend the capability of the chamber to accept input and output pipes of various outside diameter.

1 Claim, 3 Drawing Sheets

WASTE WATER ACCESS CHAMBER ASSEMBLAGE

FIELD OF THE INVENTION

This invention relates to a molded wastewater access chamber which is an comprised of separated pieces assemblage that are to be assembled at site and placed below ground level to make a waterproof unit that is to connect with a wastewater source pipe, a sewer system pipe, and a riser pipe to provide access into the chamber from ground level.

BACKGROUND OF THE INVENTION

Sanitary sewer systems generally include a series of strategically placed manholes that are connected by sewer pipes to move wastewater from sources to a sanitary treatment plant. They are generally constructed of concrete or block material and are conventionally shaped to include a cone, corbel, and bench sections. Each manhole is usually covered by a metal cover that may be removed to permit entry into the manhole for maintenance and cleaning. See, for example, U.S. Pat. No. 4,957,389. These manholes are subject to leaks through cracks in the concrete or block, and numerous patents have issued showing ways to patch the manhole to stop the leaks. Also reinforced plastic casings have been suggested to replace the concrete manholes, as well as formed casing that are sectioned together at a construction site. See, for example, U.S. Pat. Nos. 3,938,285 and 4,089,909.

To bridge the gap between the concrete manholes and devices such as plastic casings, I invented a molded, hollow, one-piece, polyethylene wastewater access fitting that is connected below ground to external wastewater and sewer pipes. See my U.S. Pat. No. 5,361,799. The access fitting connects a wastewater source to a sewer system without the expense and labor of constructing a concrete manhole or lengthy assembly of materials for most needs to transfer wastewater to a sewer system. It has a connected standpipe, or riser, for ready entrance to the interior of the access fitting through the riser for cleaning and maintenance. It can be used as a supplement to a manhole. The riser is sealed at its top just below ground level but its lid can be removed to permit insertion of equipment used for maintenance or cleaning. The lid can be reinstalled to again make the access fitting watertight.

The access fitting has extensions molded to opposite ends at the bottom of its body. These extensions protrude outwardly with sections of decreasing outside diameter pipe. The sections are equal in size to the varying pipe sizes that may be connected to the access fitting. A section of the extension may be severed at a selected size to connect a pipe of that size to the access fitting.

The access fitting is impervious to acids and strong effluents that may normally flow through a manhole. It will not crack or swell as temperatures change. These features significantly reduce maintenance that is often experienced with concrete manholes because of ground shifts that crack the concrete or stress caused by extreme temperature shifts. The access fitting, while having many salient features that make it viable for use, is expensive to ship in bulk because of its large size with the extensions attached.

With the benefits achieved with the access fitting in mind, we have invented a wastewater chamber an assemblage that because of its separate but connectable pieces, is compact for handling, simple to install, and has all of the benefits realized with the access fitting, and because the assemblage is compact in size, it can be packaged for economical shipment in bulk.

Therefore, an object of our invention is to provide a simple, molded, chamber assemblage that is compact and easy to handle and can be quickly assembled and connected at a site to wastewater input and output pipes in a watertight manner, and sealed with an attachable lid that can be easily removed to permit ready access into the interior chamber from ground level for maintenance or inspection and can be easily resealed.

A feature of our invention is a wastewater chamber assemblage that is easily and quickly assembled and connects to wastewater pipes when placed below ground level to collect and transfer wastewater to a treatment plant and be easily accessed with maintenance equipment from above ground by removing an attachable watertight lid that seals the riser.

It is another feature of our invention that the chamber assemblage is compact for ease of handling and economy of shipping in bulk to a site for installation.

An additional feature of our invention is that the chamber includes connectable extensions that are part of the assemblage that are easily and quickly connected to the chamber to make a complete unit and to input and connect output pipe spigots of various size to increase the capability of the chamber to convey wastewater received from pipes of different outside diameter.

SUMMARY OF THE INVENTION

Our invention is a wastewater access chamber assemblage of separate pieces that are to be assembled on site and placed below ground level to connect a pipe from a wastewater source, a pipe connected to a sewer system, and to a riser, when required depending upon the depth below ground level, which extends from the chamber to just below ground level. The assemblage comprises the chamber with open spigots and open riser and, an attachable riser lid, attachable extensions for the chamber, and when desired commercially available pipe spigot attachments. The attachable extensions and commercially available pipe spigot attachments extend the capability of the chamber to connect to input and output sewer pipes of different outside diameter.

We mold the chamber as a one-piece, hollow, chamber with open pipe spigots that protrude horizontally outward from the opposing bottom ends of the chamber to receive extensions, and a base riser attachment on the top of the chamber made up of the base and connected open riser attachment spigot, both of which open into the interior of the chamber. We mold the lid with a grove in its outer surface to receive an "o" ring, which when the lid is seated in the riser attachment spigot or an attached riser, makes a watertight seal. The "o" ring seal connection makes it easy to remove and replace the lid. Two connectable, molded, polyethylene chamber spigot extensions attached before installation connect the chamber spigots to input and output pipes of smaller outside diameter than the chamber spigots. The extensions have connected, stepped-down pipe sections, each section being smaller in diameter than a preceding section. A selected, stepped down section may be severed to provide a pipe spigot to connect to an input or output pipe. Additionally, the chamber is designed to accept commercially available parts that connect the chamber spigots to input and output pipes of smaller outside diameter. These parts include, but are not limited to, eccentric couplings, conventional couplings for pipe spigots, and other multidirectional spigot connections, thus increasing the total horizontal connections to three or four.

DETAILED DESCRIPTION OF THE DRAWINGS

Figure 1:
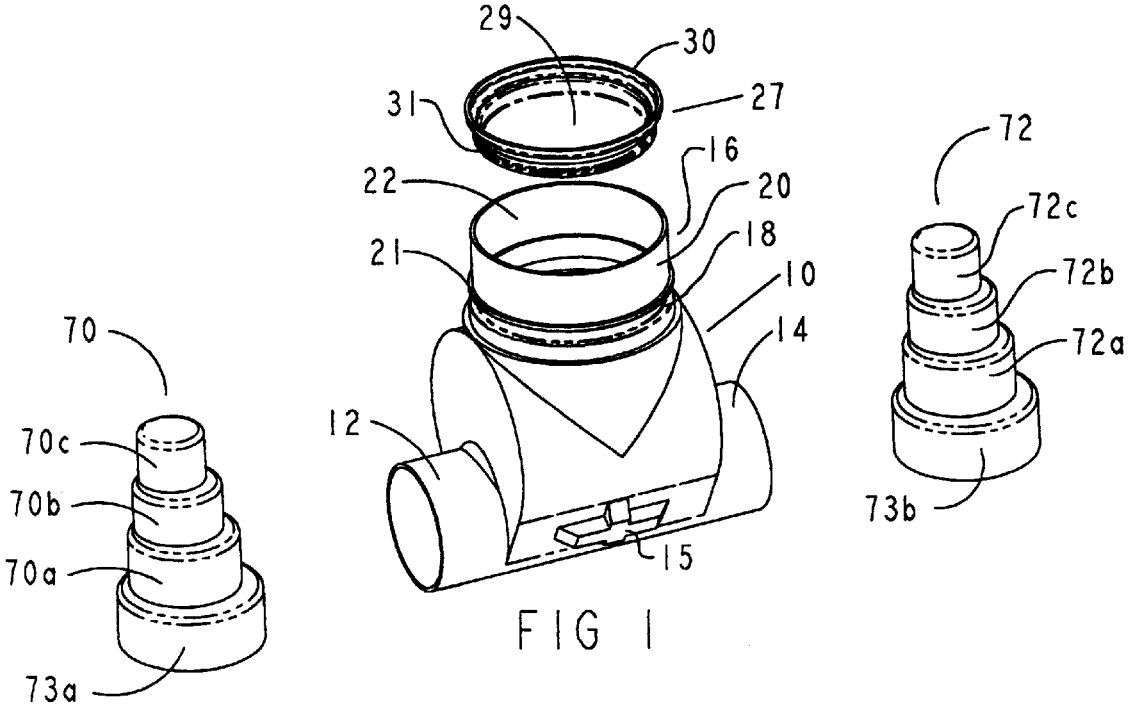
FIG. 1 is a perspective view of the molded chamber assemblage.

We refer you first to FIG. 1 where we show the chamber assemblage that includes several separate pieces to be connected on site a chamber, a riser lid, and two chamber extensions. The chamber 10 is a molded, one-piece chamber with open pipe spigots 12 and 14, protruding horizontally from opposing bottom ends, a circular riser attachment 16 that has a riser attachment base 18, and a connected riser attachment spigot 20, separated by a circular flange 21. The riser attachment base 18 and riser attachment spigot 20, open at its top 22 through the flange 21 into the interior of the chamber 10. The chamber 10 can be molded to any size that a site dictates, and the chamber pipe spigots 12,14 can be of any selected size but generally are the maximum size to facilitate stepping down in size, and more than two if desired. We mold reinforcing ribs 15 to the lower opposite sides of the chamber 10 to increase body strength to withstand increased pressure if the chamber assembly is placed deeply (e.g. 30 ft) below ground level. We prefer a 100% virgin, hexen, linear, low density, Roto molding grade, cross linked, UV stabilized polyethylene.

Figure 2:
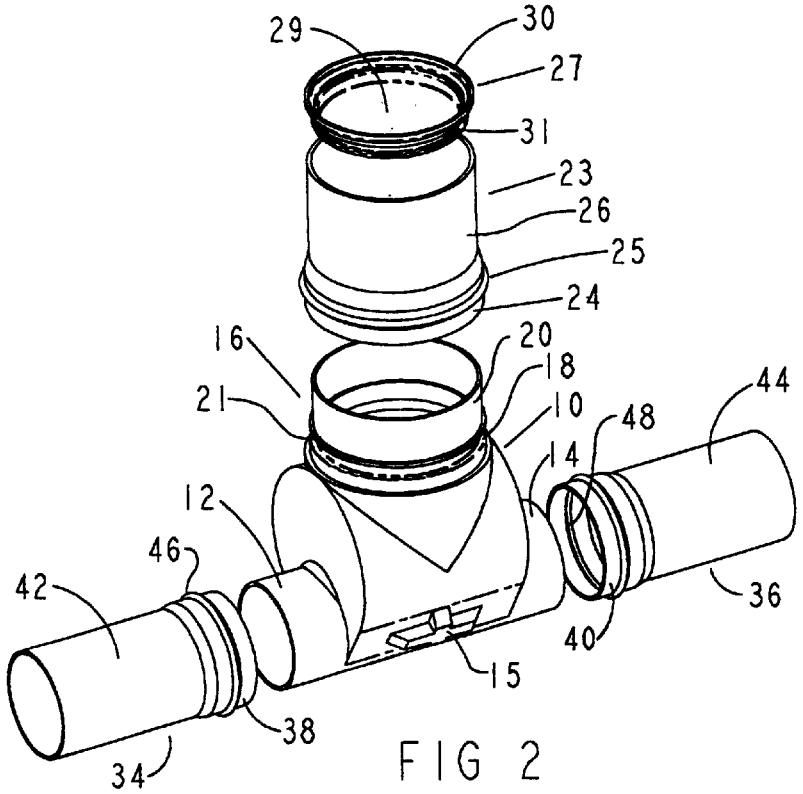
FIG. 2 is an exploded view of elements of the chamber assemblage with input and output pipes and a riser to be attached.
Figure 3:
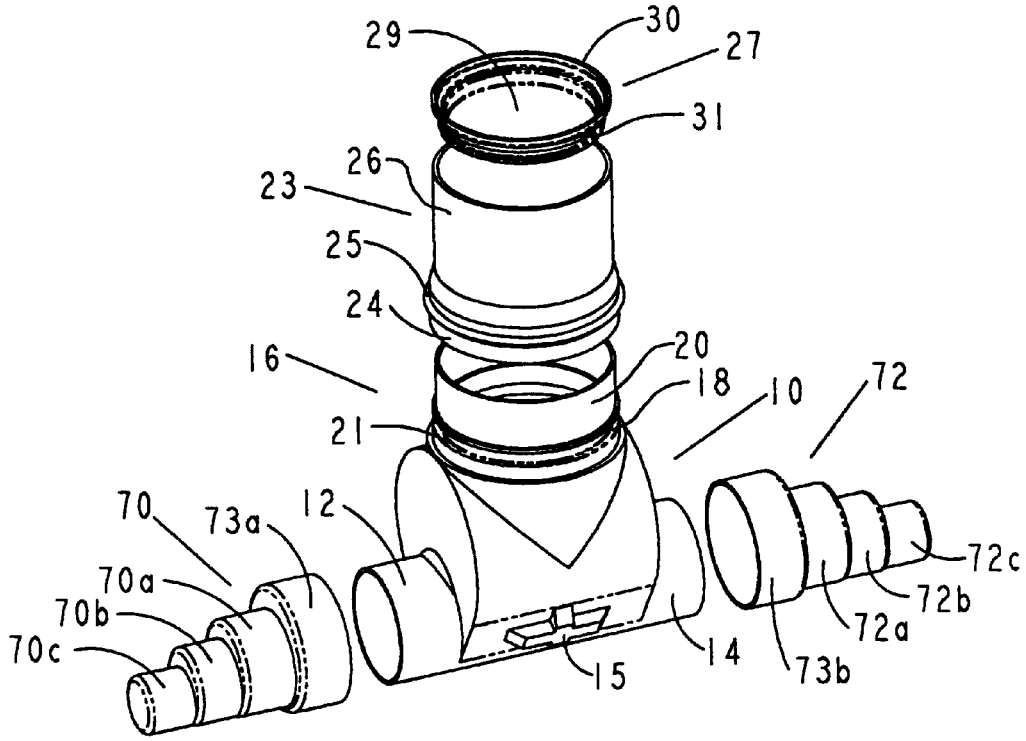
FIG. 3 is an exploded, perspective view of the chamber assemblage that includes attachments for the chamber to connect pipes of smaller outside diameter, and a riser.
Figure 4:
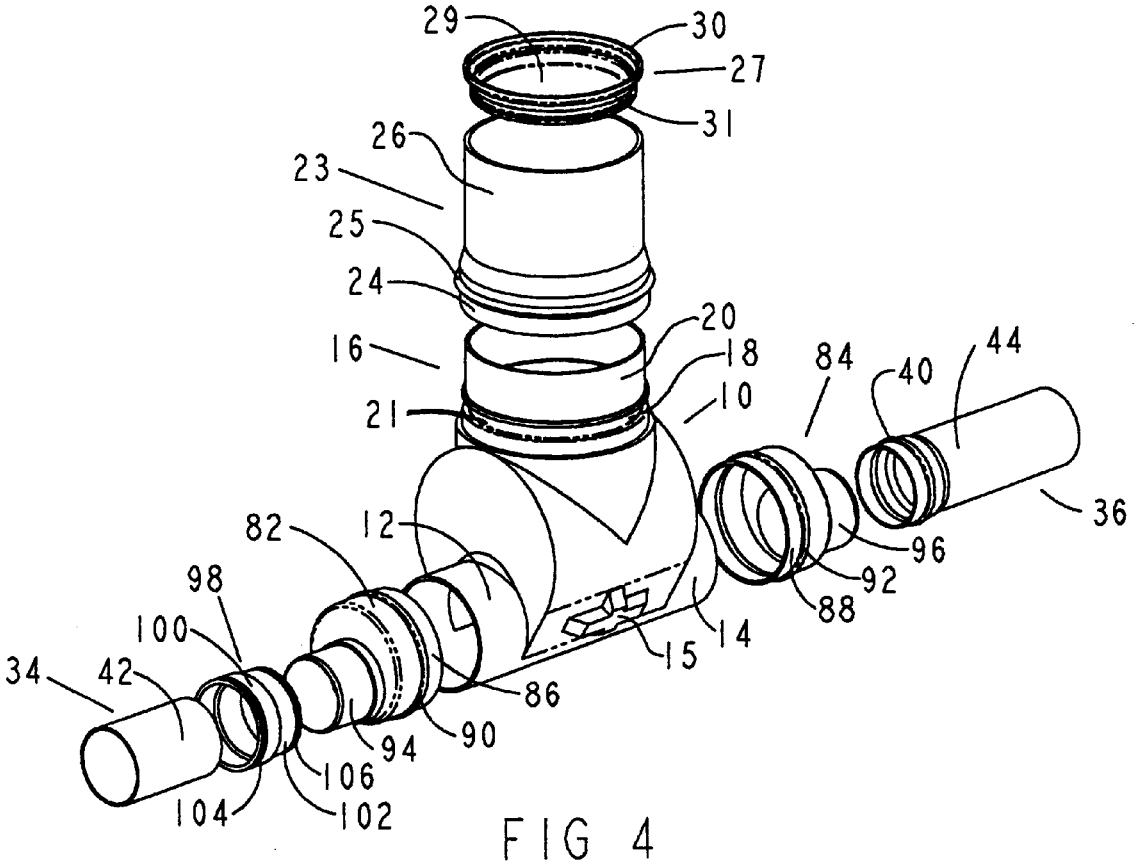
FIG. 4 is an exploded, perspective view of elements of the chamber assemblage with commercially available parts connectable to the chamber, and riser.

A riser 23, shown in FIGS. 2, 3, and 4, when required, is to be attached to the riser attachment spigot 20. The riser 23 is of conventional pipe design with a bell 24, a gasket grove 25, and spigot 26. Selected sizes of pipe for risers are commercially available. The input and output pipes that attach to the chamber are also of conventional design, each having a bell and a spigot. Each bell is grooved to receiver a gasket that will fit between the inside of the pipe bell and chamber spigot to make a watertight connection.

We make the interior of the chamber 10 readily accessible from ground level for inserting maintenance equipment through the riser attachment spigot 20, or the riser spigot 26. We seal the top of the riser that is used with a removable lid 27. The lid 27 is molded in the same mold when the chamber 10 is molded but is not attached thereto. The lid 27 is formed with an outside diameter at its bottom 29 that is smaller in outside diameter than the inside diameter of the riser attachment spigot 20 and the riser spigot 26 at 22 so that it may be inserted therein. We attach the lid 27 to the riser attachment spigot 20, or the riser spigot 26, so that it can be easily removed by using a projection 30 that is formed to the lid 27. The projection 30 is larger in outside diameter than the outside diameter of the riser spigot 26 and will seat thereon. The outer surface of the lid 27, beneath the projection 30, is grooved at 31 to receive an "o" ring 32, not shown, which when the lid 27 is inserted in the opening 22, will seat against the inside wall of the riser attachment spigot 20 or the riser spigot 26, to make a watertight union that can be easily removed and replaced.

Figure 5:
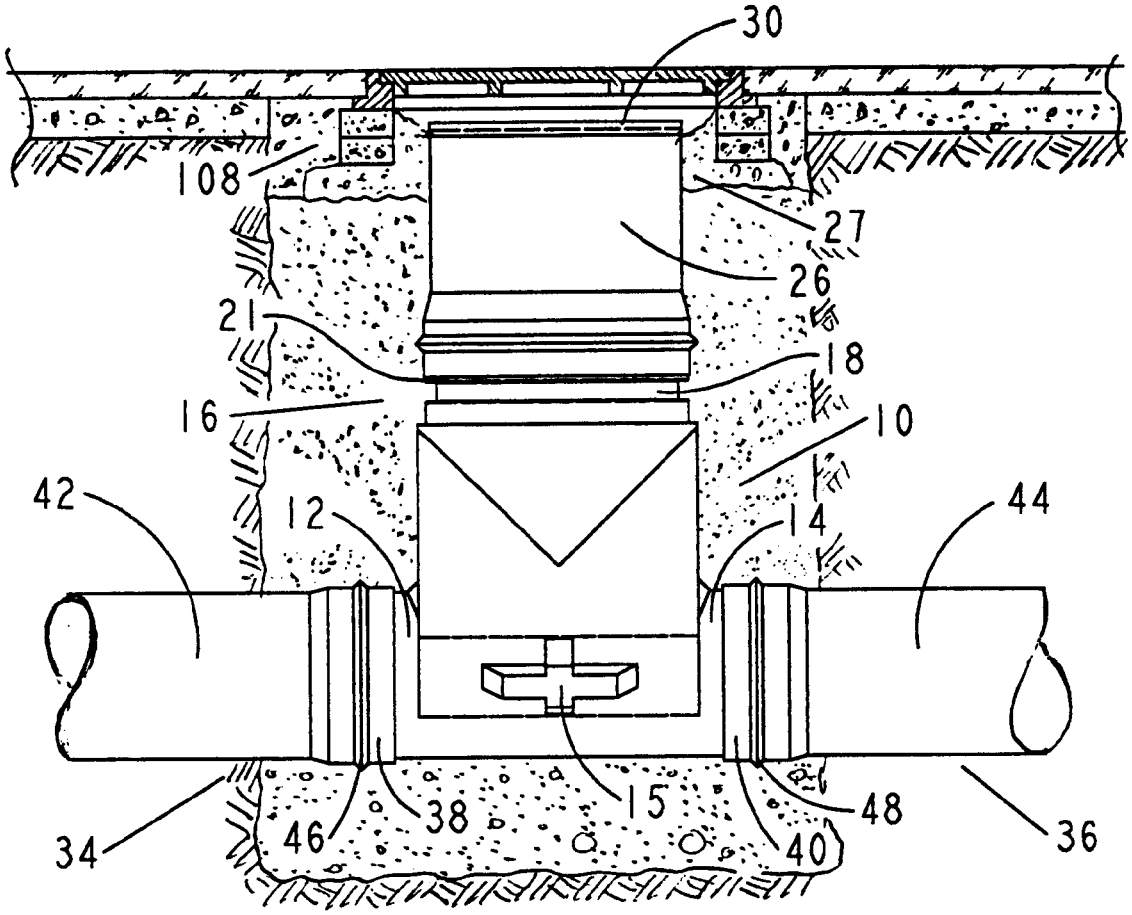
FIG. 5 shows the chamber assemblage of FIG. 2 assembled and installed below ground level.

In the exploded view of FIG. 2, we show the chamber assemblage that receives an input pipe 34, an output pipe 36, the riser 23, and the lid 27. The pipes 34,36 being of conventional design, have bells 38,40 and spigots 42,44 with a gasket grooves 46, 48 in each bell. The chamber 10 is placed below ground level where the input and output pipe bells 38,40 with gaskets in the grooves 46,48 are placed over the chamber spigots 12,14 making their seal watertight. The riser bell 24 with gasket in grove 25 is slid over the riser attachment spigot 20 until it reaches the flange 21, and the lid 27 is inserted into the opening 22 of the top of the riser spigot 26 with the "o" ring 32 in position. The assembly, shown in FIG. 5, is complete.

FIG. 3 shows the chamber assemblage that we suggest be used when the input and output pipes 34,36, of FIG. 2, have an outside diameter that is smaller than the chamber spigots 12,14. We provide two molded, polyethylene chamber spigot extensions 70,72 that attach to the chamber spigots 12,14. The extensions 70,72 are also shown in FIG. 1. The extensions 70, 72 are molded to be identical and have a series of connected, steppeddown pipe sizes 70*a*–70*c* and 72*a*–72*c*. Each extension 70,72 include bells 73*a*,73*b* that connect to the chamber spigots 12,14. The bells 73*a*,73*b* include gaskets to make watertight connections with the chamber spigots 12,14.

The usual pipe sizes that would be stepped down to are 10 inch, 8 inch, and 6 inch. The stepped sections may be severed to open the chosen pipe size to be connected to a pipe bell or coupling with attendant gasket to make the connection watertight. If the user of the chamber assemblage prefers commercially available parts, we designed the chamber 10 to receive such parts that will connect the chamber spigots 12,14 to the input and output pipes 34,36 when they are smaller in outside diameter than the chamber spigots 12,14.

FIG. 4 shows the recommended chamber assemblage that uses commercially available parts. The parts include eccentric couplings 82,84. Eccentric couplings are required because the flow of water through the chamber 10 is at the very bottom. Eccentric couplings will continue the flow from the bottom. Each coupling 82,84 includes a bell 86,88, with gasket grooves 90,92, and spigots 94,96. In general, eccentric couplings 82,84 connect directly to a series of pipes. However, the normal connection of pipe spigots and bells is interrupted when the chamber is put between the normal connection. A different type coupling 98 is required in addition to the eccentric coupling for one side of the chamber connection to complete the connection with an input or output pipe. We use a conventional coupling 98 that has bells 100,102 with gaskets 104,106 which connect the coupling 98 to the spigots of pipes 34,94 or 44,96. The couplings 82,84 and 98 are selected of size to connect the chosen input and output size pipes to the chamber 10.

In FIG. 5 we show an assembly in which the chamber 10 is attached to pipes 34,36 and the riser bell 24 with lid 27 attached, all of which is placed below ground level. A manhole cover with supporting structure 108 are placed at ground level giving easy access to the lid 27 for removal to enter the chamber 10 from above ground.

Thus it can be seen that our chamber assemblage, when assembled below ground level, accepts input and output pipes of various size that can be quickly connected, and entry into the chamber of maintenance equipment from ground level for pipe maintenance can be readily accomplished by simply removing the lid from the riser. After pipe maintenance, returning the riser to a watertight condition is accomplished by replacing the lid.

We claim:

1. A molded polyethylene chamber assemblage comprised of separate pieces to be assembled on site and placed below ground level to connect with input and output sewer pipes to receive, collect, and transfer wastewater to a treatment plant, and to a riser to provide entrance into the interior of the chamber through the riser to insert maintenance equipment, comprising:

a molded, one piece, polyethylene wastewater chamber having at least two chamber spigots open into said chamber and extending horizontally from opposing bottom ends of the chamber to receive an extension to be connected thereto and to the input and output sewer pipes, and a riser base on top of said chamber, said base also including a riser spigot, both open into said chamber, an attachable molded polyethylene lid for sealing said riser spigot, at least two molded ribs on the sides of said chamber running vertical from top to bottom, and two molded polyethylene spigot extensions, each having a bell that attaches to one of the chamber spigots, each extension having a series of molded pipe spigots that are stepped from the bell in decreasing outside diameter pipe sizes, where each successive spigot may be severed to open a specific size spigot for attachment thereto by input and output sewer pipes.

* * * * *